US012313286B2

(12) United States Patent
Lang et al.

(10) Patent No.: US 12,313,286 B2
(45) Date of Patent: May 27, 2025

(54) HEAT PUMP

(71) Applicant: VIESSMANN CLIMATE SOLUTIONS SE, Allendorf (DE)

(72) Inventors: Eduard Lang, Allendorf (DE); Lars Kautzner, Marburg (DE); Lukas Boehle, Burgwald (DE)

(73) Assignee: VIESSMANN CLIMATE SOLUTIONS SE, Allendorf (DE)

( * ) Notice: Subject to any disclaimer, the term of this patent is extended or adjusted under 35 U.S.C. 154(b) by 164 days.

(21) Appl. No.: 18/279,340

(22) PCT Filed: Feb. 21, 2022

(86) PCT No.: PCT/DE2022/100133
§ 371 (c)(1),
(2) Date: Aug. 29, 2023

(87) PCT Pub. No.: WO2022/184208
PCT Pub. Date: Sep. 9, 2022

(65) Prior Publication Data

US 2024/0151429 A1 May 9, 2024

(30) Foreign Application Priority Data

Mar. 1, 2021 (DE) ..... 10 2021 104 783.8

(51) Int. Cl.
*F24F 13/22* (2006.01)
*F24F 1/12* (2011.01)
*F24F 13/20* (2006.01)

(52) U.S. Cl.
CPC ..... *F24F 13/222* (2013.01); *F24F 1/12* (2013.01); *F24F 13/20* (2013.01); *F24F 2013/202* (2013.01)

(58) Field of Classification Search
CPC ..... F24F 13/22; F24F 13/222; F24F 13/20; F24F 13/24; F24F 2013/202; F24F 1/12; F24F 1/40; F24F 30/02; F24F 2221/12
See application file for complete search history.

(56) References Cited

U.S. PATENT DOCUMENTS

2007/0148013 A1* 6/2007 Hong ..... F16F 15/067 417/360
2017/0051965 A1* 2/2017 Lokhande ..... F25D 23/006

FOREIGN PATENT DOCUMENTS

EP 3 745 033 A1 12/2020
EP 3 825 158 A1 5/2021
(Continued)

OTHER PUBLICATIONS

English translation of the International Preliminary Report on Patentability and Written Opinion of the International Searching Authority in PCT/DE2022/100133, mailed Sep. 14, 2023.
(Continued)

*Primary Examiner* — Joseph F Trpisovsky
(74) *Attorney, Agent, or Firm* — Collard & Roe, P.C.

(57) ABSTRACT

A heat pump includes a housing, a housing opening that is provided in the housing and is in the form of a water drain, at least one heat-pump component that is elastically mounted in the housing, and a transport securing device for fixing the elastically mounted heat-pump component while the housing is being transported. The transport securing device is configured to close the housing opening with the fixing of the elastically mounted heat-pump component released.

10 Claims, 1 Drawing Sheet

(56) References Cited

FOREIGN PATENT DOCUMENTS

Figure 1:
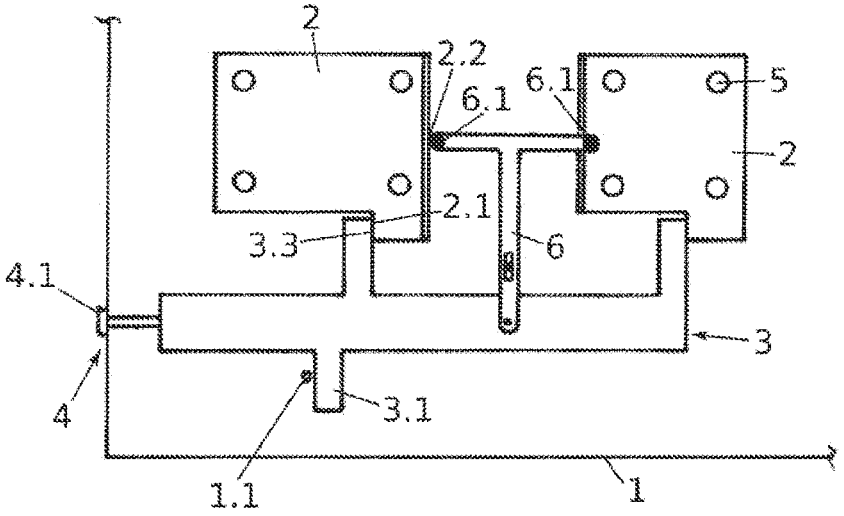

| | | | |
|---|---|---|---|
| JP | 2013-068386 | A | 4/2013 |
| WO | 2020/059142 | A1 | 3/2020 |

OTHER PUBLICATIONS

International Search Report in PCT/DE2022/100133, mailed May 25, 2022.

* cited by examiner

HEAT PUMP

CROSS REFERENCE TO RELATED APPLICATIONS

This application is the National Stage of PCT/DE2022/100133 filed on Feb. 21, 2022, which claims priority under 35 U.S.C. § 119 of German Application No. 10 2021 104 783.8 filed on Mar. 1, 2021, the disclosure of which is incorporated by reference. The international application under PCT article 21 (2) was not published in English.

The invention relates to a heat pump according to the preamble of claim 1.

A heat pump of the type mentioned in the introduction is manufactured and sold by the applicant, for example, under the product name VITOCAL 250-A. This heat pump, a so-called monobloc heat pump, consists of a housing, a housing opening that is provided on the housing and is in the form of a water drain, at least one heat pump component that is elastically mounted in the housing and a transport securing device for fixing the elastically mounted heat pump component while the housing or the heat pump are being transported. In principle, this heat pump has proved to be optimal.

The object of the invention is to improve a heat pump of the type mentioned in the introduction. In particular, a heat pump which operates even more quietly is intended to be provided.

This object is achieved by a heat pump of the type mentioned in the introduction by the features set forth in the characterising part of claim 1.

According to the invention, it is thus provided that the transport securing device is configured to close the housing opening with the fixing of the elastically mounted heat pump component released.

In other words, the solution according to the invention is characterised by the transport securing device fulfilling a dual function, namely, in addition to its actual function, it also serves as a closure for the housing opening and specifically when the elastically mounted heat pump component, preferably a compressor of the heat pump, is ready for use due to the released fixing. This stipulation provides the advantage that noise produced in the housing of the heat pump can no longer pass via the housing opening to the outside of the housing. At the same time, it is provided that the housing opening is open when the heat pump component is fixed, so that water which potentially escapes undesirably in the housing when the heat pump is being filled (which takes place when the heat pump component is fixed) can readily flow out of the housing.

Other advantageous developments of the heat pump according to the invention are found in the dependent claims.

The heat pump according to the invention, including its advantageous developments according to the dependent claims, is explained in more detail hereinafter with reference to the graphic representation of a preferred exemplary embodiment.

Schematically and as a Plan View from Above

Figure 2:
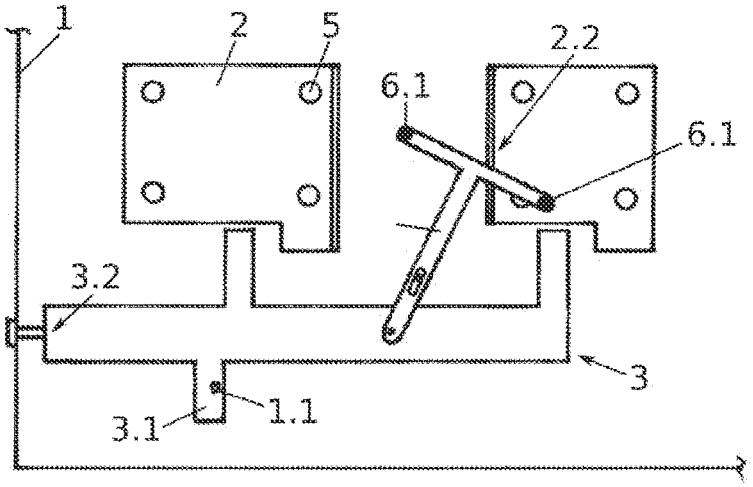

FIG. 1 shows the heat pump according to the invention with a fixed heat pump component and the housing opening open; and FIG. 2 shows the heat pump according to FIG. 1 with the fixing released and the housing opening closed.

The heat pump shown schematically (and also only partially) in the figures initially consists in the known manner of a housing 1, a housing opening 1.1 that is provided on the housing 1 and is in the form of a water drain, at least one heat pump component 2 that is elastically mounted in the housing 1 and a transport securing device 3 for fixing the elastically mounted heat pump component 2 while the housing 1 is being transported.

As can be seen from the figures, it is preferably provided that the transport securing device 3 is configured for fixing more than one elastically mounted heat pump component 2; a variant with two heat pump components 2 is shown.

It is thus essential for the heat pump according to the invention that the transport securing device 3 is configured to close the housing opening 1.1 with the fixing of the elastically mounted heat pump component 2 released.

Considered in more detail, it is preferably provided that a tab 3.1, which selectively closes or opens the housing opening 1.1, is arranged on the transport securing device 3 which is preferably movably but fixably mounted in the housing 1. This tab 3.1 is particularly preferably slidably mounted on a wall (preferably the base plate) of the housing 1 surrounding the housing opening 1.1, so that an acoustically sealed closure can be implemented. It is also preferably provided that both the transport securing device 3 and the tab 3.1 are formed from sheet metal and namely quite preferably in one piece.

For implementing an effective drainage of a liquid which has potentially escaped during start-up, it is further preferably provided that the housing opening 1.1 is arranged at a lowest point of the housing 1. Moreover, in this context it is preferably provided that the housing opening 1.1 is configured as a hole in a base plate of the housing 1.

Moreover, it is particularly preferably provided that an adjusting device 4, which can be actuated from outside the housing 1, preferably from the front face thereof, is provided for adjusting the position and fixing the transport securing device 3. This adjusting device 4 preferably comprises a screw 4.1 which can be actuated from outside the housing 1, quite particularly preferably a screw 4.1 with a screw head comprising a hexagon socket. Considered in more detail, in this context a threaded bore 3.2, which cooperates with a thread of the screw 4.1 and which can also be configured as a so-called threaded rivet, is preferably provided on the transport securing device 3. A rotation of the screw 4.1 thus leads to a displacement, preferably a horizontal displacement, of the transport securing device 3.

Moreover, preferably at least one damping element 5, which permits a displacement at least in the horizontal direction when the fixing is released, is provided between the heat pump component 2 and the housing 1 for elastically mounting the heat pump component 2 (in each case four damping elements 5 are shown for each heat pump component 2). This damping element 5 is preferably formed from an elastomer, quite particularly preferably from polyurethane foam.

Considered in more detail, it is further preferably provided that the transport securing device 3 has a first stop 3.3 which cooperates with the heat pump component 2, wherein accordingly a first counter stop 2.1 for this first stop 3.3 is preferably provided on the heat pump component 2.

It is further preferably provided that the transport securing device 3 is configured to be connected in an articulated manner to a lever 6 which is mounted in an articulated manner on the housing 1 and which has a second stop 6.1 which cooperates with the heat pump component 2, wherein accordingly a second counter stop 2.2 for this second stop 6.1 is preferably provided on the heat pump component 2.

As can be readily seen from the figures, in this context it is further preferably provided that in the fixing position the first stop 3.3 is configured to act in a first direction of action and the second stop 6.1 is configured to act in a second direction of action opposing the first direction of action.

As shown, when providing second heat pump components 2 it is also preferably provided that said lever 6 has at least two second stops 6.1. Considered in more detail, it is finally preferably provided that the lever 6 is of T-shaped configuration and the two second stops 6.1 are arranged on the opposing free ends thereof. As can be seen from FIG. 1, in particular, the stop 6.1 shown on the left-hand side pushes against the counter stop 2.2 while the stop 6.1 shown on the right-hand side pulls on the counter stop 2.2 This counter stop 2.2 is configured to this end, for example, as a chamfer which can be engaged from behind by the stop 6.1.

Quite particularly preferably it is finally provided, but not shown specifically in detail, that the first stop 3.3 is configured to cooperate positively with the heat pump component 2, in particular that the first stop 3.3 is configured to prevent a movement of the heat pump component 2 in five of six spatial directions. The second stop 6.1 is thus also configured to prevent a movement of the heat pump component 2 in the missing spatial direction. While the first stop 3.3 covers the directions upwardly, downwardly, to the left, to the right and to the front, the second stop 6.1 covers the direction to the rear, so that a movement of the heat pump component 2 mounted on the damping elements 5 can be prevented in all spatial directions.

The heat pump according to the invention functions as follows:

A starting point for consideration is the position of the transport securing device 3 according to FIG. 1, i.e. the position in which the heat pump according to the invention is delivered. In this position, the tab 3.1 is located at the side adjacent to the housing opening 1.1. If liquid (in particular water) were to escape when the heat pump is being filled, this liquid can readily drain off from the housing of the heat pump via the housing opening 1.1.

If the heat pump is then actually intended to be started up (at this time the filling is complete), the transport securing device 3 (in the figures to the left) is displaced or adjusted by means of the screw 4.1. On the one hand, this brings about the closure of the housing opening 1.1 by means of the tab 3.1. On the other hand, at the same time the first stop 3.3 is released from the first counter stop 2.1 and the second stop 6.1 is released from the second counter stop 2.2, so that the heat pump component 2 can now oscillate freely.

LIST OF REFERENCE SIGNS

1 Housing
1.1 Housing opening
2 Heat pump component
2.1 First counter stop
2.2 Second counter stop
3 Transport securing device
3.1 Tab
3.2 Threaded bore
3.3 First stop
4 Adjusting device
4.1 Screw
5 Damping element
6 Lever
6.1 Second stop

The invention claimed is:

1. A heat pump comprising a housing (1), a housing opening (1.1) that is provided on the housing (1) and is in the form of a water drain, at least one heat pump component (2) that is elastically mounted in the housing (1) and a transport securing device (3) for fixing the elastically mounted heat pump component (2) while the housing (1) is being transported, wherein the transport securing device (3) is configured to close the housing opening (1.1) with the fixing of the elastically mounted heat pump component (2) released.

2. The heat pump according to claim 1, wherein a tab (3.1), which selectively closes or opens the housing opening (1.1), is arranged on the transport securing device (3).

3. The heat pump according to claim 2, wherein the tab (3.1) is slidably mounted on a wall of the housing (1) surrounding the housing opening (1.1).

4. The heat pump according to claim 1, wherein the housing opening (1.1) is arranged at a lowest point of the housing (1).

5. The heat pump according to claim 1, wherein an adjusting device (4), which can be actuated from outside the housing (1), is provided for adjusting the position and fixing the transport securing device (3).

6. The heat pump according to claim 5, wherein the adjusting device (4) comprises a screw (4.1) which can be actuated from outside the housing (1).

7. The heat pump according to claim 6, wherein a threaded bore (3.2), which cooperates with a thread of the screw (4.1), is provided on the transport securing device (3).

8. The heat pump according to claim 1, wherein a damping element (5), which permits a displacement at least in the horizontal direction when the fixing is released, is provided between the heat pump component (2) and the housing (1) for elastically mounting the heat pump component (2).

9. The heat pump according to claim 1, wherein the transport securing device (3) has a first stop (3.3) which cooperates with the heat pump component (2).

10. The heat pump according to claim 1, wherein the transport securing device (3) is configured to be connected in an articulated manner to a lever (6) which is mounted in an articulated manner on the housing (1) and which has a second stop (6.1) which cooperates with the heat pump component (2).

* * * * *